US005559293A

United States Patent [19]

Kirkpatrick

[11] Patent Number: 5,559,293

[45] Date of Patent: Sep. 24, 1996

[54] STEAM GENERATION SYSTEM MASS AND FEEDWATER CONTROL SYSTEM

[76] Inventor: William J. Kirkpatrick, 308 Edjil Dr., Newark, Del. 19713

[21] Appl. No.: 386,304

[22] Filed: Feb. 8, 1995

Related U.S. Application Data

[62] Division of Ser. No. 123,291, Sep. 20, 1993, Pat. No. 5,406,915, which is a division of Ser. No. 847,697, Mar. 6, 1992, Pat. No. 5,249,551, which is a continuation-in-part of Ser. No. 682,390, Apr. 9, 1991, abandoned.

[51] Int. Cl.[6] ..... G01F 1/00; F22D 5/26; G21C 7/32

[52] U.S. Cl. ..... 73/861; 73/865; 60/667; 122/451.1; 122/487; 376/211; 376/246

[58] Field of Search ..... 60/667; 122/440.1, 122/451.1, 487; 376/211, 216, 258, 246, 247; 73/861, 861.02, 861.42, 865

[56] References Cited

U.S. PATENT DOCUMENTS

| | | | |
|---|---|---|---|
| 4,241,701 | 12/1980 | Morse | 122/487 |
| 4,275,447 | 6/1981 | Ruiz | 364/494 |
| 4,522,156 | 6/1985 | Chaix | 122/492 |
| 4,551,796 | 11/1985 | Singh | 364/148 |
| 4,777,009 | 10/1988 | Singh et al. | 376/211 |
| 4,912,732 | 3/1990 | Singh | 376/211 |
| 4,975,239 | 12/1990 | O'Neil et al. | 376/247 |
| 5,024,802 | 6/1991 | Srinivasan | 376/258 |

*Primary Examiner*—Richard Chilcot
*Assistant Examiner*—Paul D. Amrozowicz
*Attorney, Agent, or Firm*—Edward Dreyfus

[57] ABSTRACT

In a steam generator or boiler of the type having a pressure vessel having a zone in which heated water and steam can be separated, an outlet for the flow of pressurized steam and an outlet for the flow of liquid, a riser section in which fluid passes for heating therein and flow into the vessel zone, and a downcomer to receive the recirculated liquid from the vessel zone and feedwater for flow to the inlet of the riser section, the system includes feedwater control apparatus for sensing the mass flow of liquid in the downcomer, determining the liquid mass in the vessel zone, downcomer and riser section and controlling the feedwater rate in relation to such mass and the respective power conditions of the system, thereby providing better stability in the system operation. Trips and other problems caused by shrink and swell are thereby avoided and other benefits achieved.

4 Claims, 4 Drawing Sheets

STEAM GENERATION SYSTEM MASS AND FEEDWATER CONTROL SYSTEM

REFERENCE TO RELATED PATENT APPLICATION

This is a division of my U.S. patent application Ser. No. 123,291, filed Sep. 20, 1993, now U.S. Pat. No. 5,406,915, which is a division of my U.S. patent application Ser. No. 847,697, filed Mar. 6, 1992, now U.S. Pat. No. 5,249,551, which is continuation-in-part application of my U.S. patent application, filed Apr. 9, 1991, Ser. No. 07/682,390, now abandoned.

FIELD OF THE INVENTION

The present invention relates to devices and methods of controlling water mass and levels in a steam generator.

REFERENCE TO APPENDIX

Reference is made to my unpublished paper entitled: THE PROBLEM: SHRINK & SWELL PHENOMENON; THE CURE: A STEAM GENERATOR MASS CALCULATOR, 28 Pages, and appended hereto and incorporated herein by reference. The appendix provides the development of various mathematical formulations and algorithms for the more complete understanding of the theory of the present invention.

DESCRIPTION OF THE PRIOR ART

In power plants using steam generators, especially nuclear power plants of the pressurized water type, there has been a problem of trips (automatic shutdowns) of the power plants due to water within the steam generator reaching levels either too high or too low. These trips tend to occur at low power levels, typically less than 15% of full power steam generation.

One example of a steam generator is shown in FIG. 1, labeled "prior art". It is a boiling vessel in which highly purified water is turned to saturated steam for driving the load, such as generator turbines. It is cylindrical, about ten feet across and 50 feet high, and has a thick steel outer wall 10 capable of holding the great pressure within. Heat to boil the water comes from inverted U-tubes 12 (shown in partial sections in FIG. 1) which carry very hot water from the reactor core. The reactor water enters a chamber divided by a barrier 16 into subchambers 18 and 14. The barrier 16 forces the reactor water entering the subchamber 14 to go upward into the U-tubes 12, where it is cooled by boiling the turbine water. The reactor water exits the U-tubes 12 and goes into the subchamber 14 whence it returns to the reactor for reheating.

The turbine water in the central riser section 20 of the steam generator, where the U-tubes are located, picks up heat from the U-tubes and boils. The bubbles of steam rise up through the cylindrical riser 20 to a series of moisture separators 22, 24, which deflect entrained water from the steam so that the steam will be "dry" and the turbine blades will not be eroded by water droplets. The deflected water runs down from the separators 24 onto the top of the "wrapper" 30. The wrapper 30 is an open-ended envelope surrounding the riser section 20 and U-tubes 12. The boilover water runs over the outside of the wrapper and into the annular cylindrical space, the downcomer 40. The downcomer is located between the wrapper 30 defining the outside of the riser 20 space and the inside of the steam generator pressure wall 10. The lower part of the wrapper 30 is a cylindrical wall that separates the riser 20 from the downcomer 40. The water turns around the rim of the lower open end of the wrapper 30 and circles back into the riser 20. To make up for water turned to steam and lost to the turbine, the steam generator includes a feedwater ring 32 above the downcomer.

A blowdown tube 38 penetrates the wall 10. The inner end is open for draining the steam generator.

The trips occur at low power because the circulation characteristics of the steam generator change drastically within the low-power range. At very low power levels, little steam is produced, and the riser is like a gently bubbling pot: the bubbles rise to the surface 34 (i.e., the water/steam interface) and their steam is released to pass out of the steam generator through the opening 36. Virtually no water is carried above the surface 34. At between 5% and 10% of full power, though, the water in the riser begins to bubble vigorously and "boils over". Much entrained water is now carried to the top of the riser 20 by the fast-moving steam. The separators 22, 24 trap the ejected water and deflect it out of the steam path. The recirculated water runs into the downcomer and moves down toward the riser. The steam generator has shifted from a once-through pot boiler mode to a recirculating mode.

At very low power, the water levels inside of and outside of the wrapper are the same. At higher power, the greater circulation of entrained water in the steam causes the levels to differ. The effects of water/steam velocity and density variations caused by steam bubbles entrapped in the downcomer water and temperature also play a part in water level differences. The fact of recirculation indicates a pressure differential between the riser and downcomer sections.

The amount of steady-state recirculation is described by a number called the circulation ratio. This is the ratio of mass flow in the downcomer 40 to the mass flow of steam leaving the steam generator through the outlet 36. In the pot boiler mode, the ratio is 1:all the steam leaving is replaced by water from the ring 32. As power increases (power is roughly proportional to mass outflow rate of steam) the circulation ratio changes.

The recirculated water/steam which "boils over" increases monotonically with power level. However, the rate of increase is greatest when boilover first occurs. However, the amount of steam drawn off is roughly proportional to power level. Therefore the circulation ratio is greatest at the point where the boilover is increasing rapidly. This is illustrated by typical figures, from a Westinghouse model 51 steam generator.

From 0% to 5% the absolute mass rate of steam leaving the generator equals the water introduced into the feed ring 32; both rise from 0 to 0.2 million lbm/hr, and the circulation ratio stays at 1 (pot boiler mode). Between 5% and 10% of full power, the steam output doubles but the circulation flow in the downcomer increases more than 60 times to about 12.5 million lbm/hr, so that the circulation ratio reaches 33.5 at 10%. This is the region of greatest change. Between 10% and 100% of full power the amount or recirculating boilover water does not change greatly. The downcomer flow at 100% is 19.5 million lbm/hr. By the time the power is 100%, the circulation ratio has fallen to 5.2 on account of the relatively steady increase in downcomer flow and increasing steam output flow. The change rate is greatest between 5% and 10%.

These figures assume a constant mass of water in the steam generator (mass rate of feedwater is equal to steam out) and steady state thermal conditions.

Together with the introduction of relatively cold feedwater, the rapid changes at low levels can cause the "shrink and swell" phenomenon. This phenomenon involves counter-intuitive reactions of the water level to the actions of the operator or the automatic feedwater control system. Shrink and swell may cause plant operators to become confused and lose control of the steam generator water level, which rises of falls too far. Trips result automatically when the level exceeds certain bounds.

In controlling the steam generator, a plant operator must rely upon limited data to control the water level inside the riser. Due to high pressure and temperature inside the steam generator (about 1000 psi and 545 degrees Fahrenheit) connections to the outside are kept to a minimum. Basically, the operator relies for information upon two pressure sensors 50, 60 which report the "narrow range" and "wide range" water levels.

The pressure sensors 50, 60 are of the differential type. Each one typically comprises a flexible diaphragm separating two pressure regimes, and a sensor to translate into an electrical signal the diaphragm displacement caused by the pressure difference on the two sides. Wires are shown leaving the sensors to convey the pressure signals away to respective indicating gauges (not shown). The sensors 50, 60 are connected between two levels of the steam generator to monitor the water level inside by hydrostatic pressure. (If absolute pressure sensors were used, the small pressure differences between levels due to the hydrostatic pressure of a few feet of water would be "swamped" by the great absolute pressure in the steam generator.) As seen in FIG. 1, each sensor is connected in the mid range of a respective horizontal lower pipe 52, 62 leading out from the steam generator pressure vessel. The sensors 50, 60 thus divide the pipes 52, 62 into two pressure regimes. Head pipes 54, 64 rise vertically from the ends of the lower pipes 52, 62 and connect to respective horizontal upper pipes 56, 66 which connect to the steam generator again.

The head pipes 54, 64 will fill with water due to condensation of steam from the steam generator through a standard condensing device, not shown. Thus, the pipes 54, 64 will present a fixed reference hydrostatic pressure to one side of each sensor. Each of the sensors 50, 60 thus reports the difference between the reference pressure at the bottom of the head pipe 54, 64 and the pressure inside the wall 10 where the pipe 52, 62 enters the steam generator.

If the water and steam inside the steam generator were calm, the narrow and wide range sensors 50, 60 would indicate readings differing merely by a constant. Since their gauges are calibrated to show water elevations, the indicated levels would be the same. However, this is not the case. The two sensors often indicate water level differences of more than a foot. There are several reasons for this.

First, the water in the hydrostatic reference vertical pipes outside the steam generator vessel contains water at about 120° F., while the water inside is at about 545°. The hotter water is less dense, so the same hydrostatic pressure on either side of the pressure transducer indicates a higher water level inside. However, this effect is normally compensated for in the calibration of the narrow and wide range gauges.

Second, the density of the water inside is lowered because of steam bubbles in the boiling water in the riser. These bubbles lower the density by a large factor. Moreover, bubbles are also entrained in the recirculating water in the downcomer.

Third, the motions of the water through the passages of the steam generator involve pressure drops due to the viscosity of the water. Especially in the long, narrow downcomer 40, the pressure will drop as the water flows through the passages. This effect decalibrates the wide range reading by up to 5% in some steam generators. (It should be noted that the level inside the riser will necessarily be lower than the level in the downcomer, else there would be no circulation.)

Because of these effects, the water elevation levels indicated by the wide and narrow range indicators will often differ by more than a foot.

The operator desires to know the water level that would result if the steam outlet valve and the feedwater valve (not shown) were both shut off at once, along with the neat input from the U-tubes 12. This is the "true" static equilibrium level.

The water level inside the riser 20, where the heating U-tubes 12 are located, is most important. If the riser level is too high, the water will boil up past the separators 22, 24 and damage the turbine. If it is too low, the U-tubes 12 will be "dry out" and insulating scale may form on the U-tubes. There is also the danger that the reactor water returning to the reactor core may not be sufficiently cooled. Yet, the operator has no direct measurement of the level of water in the riser 20. The operator must rely instead upon the narrow range and wide range readings and upon other transducers (not shown) which measure the flow of steam out of the generator, and the flow of replacement water into it.

Many reactor trips are caused by the operator mis-reacting to the "shrink and swell" phenomenon, a rising narrow-range indicated water level accompanied by a falling wide range level. It usually happens after feedwater injection is cut off during low-power operation. The feedwater during low-power operations is unheated because the feedwater preheater is not receiving steam due to the low steam flow. The feedwater at low power is therefore about 400° F. cooler than the recirculated boilover water in the downcomer. It has the effect of chilling the recirculated water and causing the collapse of bubbles entrapped in it. This changes the density greatly, both by collapsing bubbles and by changing the water density. When the feedwater is stopped, the density decreases again and the level indicated by the narrow range pair of sensors shoots up. If it shoots high enough, the generator trips and automatically shuts down the plant. The operator tends to react as if the water is too high, and does not turn the feedwater on again.

Rapidly changing density and temperature in the downcomer cause the recirculation to change, and also the riser temperature. Changes in temperature in turn cause Changes in the steam flow.

When the steam flow varies, so does the steam pressure at the generator outlet 36 (because of pressure drop over the separators 22, 24 and in the riser 20). These pressure changes are not negligible: steam pressure may vary as much as 200 psi over the full power range. Because steam generators are often connected in parallel, these changes aggravate the problem of shrink and swell. If one of the generators drops its pressure, the next generator will feel the pressure drop in the header and increase its output. The result may cause a chaotic oscillation involving load shifting among the generators or waste of water and power due to atmospheric venting.

The complexities of the shrink and swell phenomenon have been addressed by several prior art inventions.

U.S. Pat. No. 4,975,239 issued to O'Neil et al. shows a boiling water nuclear reactor core with turbines inside to force flow of coolant over the core. The turbines are mounted on an annular plate. Pressure sensors are used to monitor the pressure on either side of the plate; the difference is used to calculate flow of coolant. The pressure data is combined with data from power range monitors in the core by means of an algorithm. The calculation outputs core flow.

Singh, in U.S. Pat. No. 4,912,732, discloses a control for nuclear power plant steam generators at low power. The control system inputs data on reactor power, feedwater temperature, and narrow range pressure as read by conventional detectors. The output is the feedwater flow or rate. The system is designed to stabilize the steam generator in the transition from low power to high power. This system is complex and does not calculate mass changes inside the steam generator riser.

Miranda, in U.S. Pat. No. 4,832,898, teaches the use of an automatic delay for avoiding reactor trips. The delay circuit senses the low water levels characteristic of the shrink and swell phenomenon, and locks the feedwater. This prevents the operator from reacting in the characteristic way which leads to trips. This system is simple, but does not attack the problem; it is a purely symptomatic solution, and could perhaps be dangerous in some situations where the operator needed to turn on the feedwater to prevent the U-tubes from drying out.

U.S. Pat. No. 4,728,481 issued to Geetz discloses a control system which operates over the full power range. A conventional high power controller and a conventional low power controller are used, and their outputs are linearly combined for feedwater rate control. The combination bridges the sensitive range where shrink and swell is common.

A principal object of the invention is to provide a feedwater control system for steam generators that reduces the chances of trips occurring during start-up and low power operation of the system.

Another principal object of the invention is to provide a process for controlling feedwater injection to a steam generator in a manner that reduces the chances of trips occurring during start-up and at low power operation of the system.

Another object of the invention is to achieve the aforementioned objects by controlling the mass of water in the steam generator for respective power conditions of the system or for respective density and flow conditions in the downcomer.

Another object of the invention is to provide indication of the differential pressure in the downcomer and to use such indication information to control the feedwater injection to the steam generator.

Another object of the present invention is to provide a method and apparatus for calculating the mass of water inside a steam generator for any power condition.

Another object of the present invention is to provide an apparatus allowing the operator to easily determine the mass of water inside the steam generator, which is simple and easy to adapt to existing steam generators.

Another object of the present invention is to provide a method and apparatus which allows either the operator or the automatic control system to control feedwater injection in relation to the mass liquid in the steam generator.

Another object is to provide such an apparatus that is easily adapted to and installed on existing steam generators.

These and other objects of the present invention will become readily apparent upon further review of the following specification and drawings.

SUMMARY OF THE INVENTION

In a steam generator or boiler of the type having a pressure vessel having a zone in which heated water and steam can be separated, an outlet for the flow of pressurized steam and an outlet for the flow of liquid, a riser section in which fluid passes for heating therein and flows into the vessel zone, and a downcomer to receive the recirculated liquid from the vessel zone and feedwater for flow to the inlet of the riser section, the system includes feedwater control apparatus for determining the mass flow of liquid in the downcomer, determining the liquid mass in the vessel zone, downcomer and riser sections and controlling the feedwater rate in relation to such mass and the respective power conditions of the system, thereby providing better stability in the system operation. Problems due to "shrink and swell" effects are thus avoided.

BRIEF DESCRIPTION OF THE DRAWING

Similar reference characters denote corresponding features consistently throughout the attached drawings.

DETAILED DESCRIPTION OF THE PREFERRED EMBODIMENT

Figure 1:
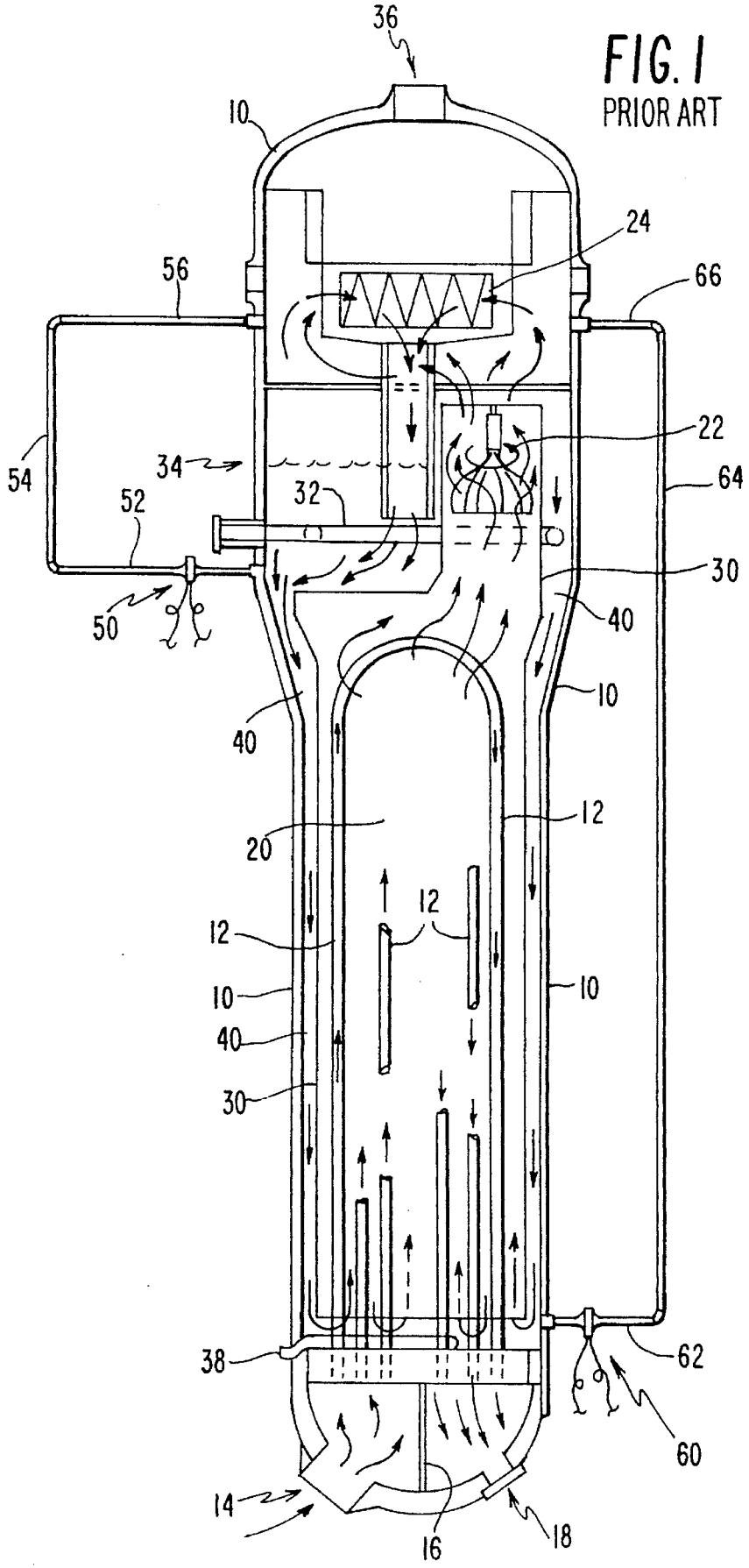
FIG. 1 PRIOR ART
FIG. 1 is a cutaway elevation view showing a typical prior art steam generator.
Figure 2:
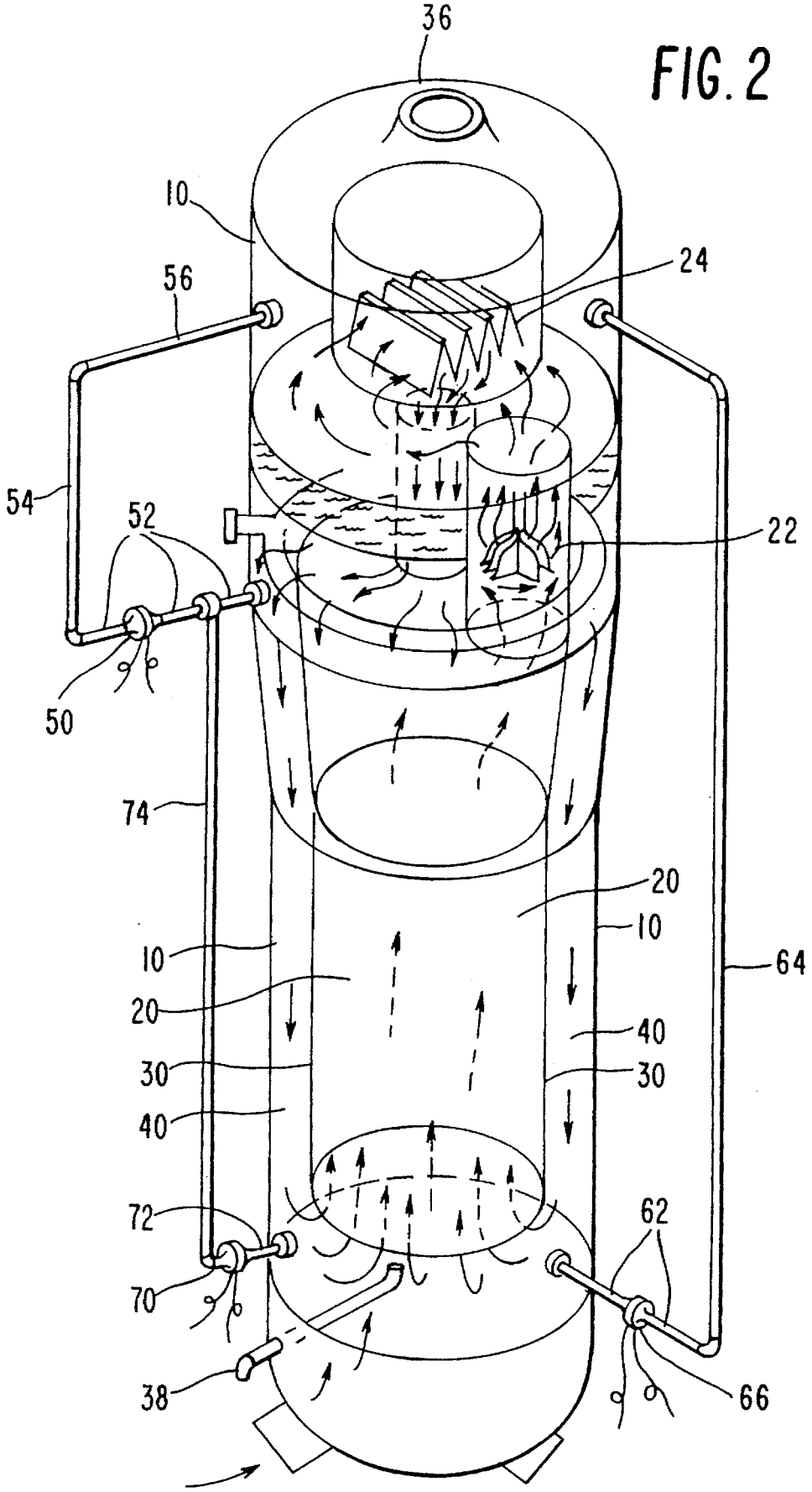
FIG. 2 is a schematic perspective view showing an example of a steam generator according to the present invention.

The present invention is shown in FIG. 2. Reference may also be made to FIG. 1, which depicts an identical type of steam generator, and to the above discussion of the prior art regarding FIG. 1. The U-tubes 12 inside the riser 20 are not shown in FIG. 2 for the sake of clarity.

FIG. 2 shows the pressure sensors 50, 60 of FIG. 1 with their accompanying arrangements of pipes 52, 54, 56 and 62, 64, 66, which connect them into the steam generator pressure vessel.

The steam generator according to the present invention includes an apparatus for measuring the flow or rate of circulation through the downcomer, and a method of using that measurement to calculate the mass of water in the steam generator and in the riser 20. Along with the level readings from the narrow range and wide range sensors, the flow measurement is used to calculate both the mass of water in the steam generator, and also the distribution of that water: the mass of water in the riser then is immediately available.

Any sort of device for measuring flow could be used: sonic doppler-shift probe, propeller/generator, venturi nozzle, etc. However, the preferred flow meter device is that shown in the drawing FIG. 2, which measures the pressure drop in the narrow downcomer. Also, it should be understood that the mass flow rate through the system can be sensed at a number of suitable locations; however, sensing such mass flow in the downcomer is preferred.

The flow meter uses a pressure differential sensor 70 of the same type as sensors 50 and 60. A lower pipe 72 is split into two pressure regions by the sensor 70. A head pipe 74 rises vertically and connects into the lower pipe 52 of narrow range sensor 50. The pipe 74 is full of water. The sensor 70 will detect any deviation of pressure at the bottom of the riser 20 from that caused by the hydrostatic pressure of water.

The lower connection could be made to one of the lower wide range taps, as shown, or to the blowdown pipe 38.

The pressure deviation measured by the sensor 70 will be due primarily to four different factors.

One factor is density differences due to the water in the pipe 74 having a lower temperature than the water inside the steam generator pressure wall 10. This difference is about 545–120 or 425° F. These inside and outside temperatures are only roughly constant, though. The inside temperature will vary by about 50° F. over the full power range. Because of this, the corresponding density variations are also only roughly constant, but can easily be compensated for, to a first approximation.

The second factor is density change of the downcomer water due to bubble entrapment. This will cause a hydrostatic pressure difference across the sensor 70 diaphragm, proportional to the density of fluid in the downcomer. The water in the head pipe 74 contains no bubbles and does not vary with this factor. The pressure differences measured across the sensor 70 will be most strongly influenced by this factor.

The third factor is pressure difference due to fluid friction or viscosity of the downcomer water. A pressure differential is required to move the water through the narrow downcomer. As flow increases, the pressure differential across the vertical length of the downcomer will increase. To a first approximation, the friction will be independent of density, because the bubbles are merely carried along with the water.

The fourth factor is the pressure drop at the tap points where the pipes 52, 72 enter the vessel. According to Bernoulli's principle, the difference at either point is proportional to density and to the square of the fluid speed there. The speed is the fluid volume flow rate divided by the cross-sectional area at that point. Thus the Bernoulli effect will vary depending on where the tap points of the pipes 52 and 74 are located: in constricted regions of high fluid speed, or regions of large cross-sectional area where the flow is slower. This effect, which opposes the viscosity pressure drop, may be made quite small by proper location or construction of the tap.

A temperature compensation could be built into the mass calculator. The easiest method of temperature compensation is to allow the actual resultant "effect" to be used, rather than compute one. The change seen above the low level tap of the narrow range instrument will also be noticed by the sensor 70. This provides for direct measurement of the effects of any temperature change. The decrease in the pressure difference across the narrow range sensor 50 will be seen as a corresponding decrease in the static condition pressure difference detected by the sensor 70. This change in both will be canceled out in the method of the present invention; the mass calculation will therefore be accurate in spite of feedwater temperature changes. The sensor 70 will not be affected by an actual level change. Therefore, the calculation of the present invention can determine the difference between temperature changes and level changes. The temperature compensation automatically occurs, without the need for temperature probes, additional inputs, or math calculations.

If another sort of flow sensor were used with the present invention, a temperature sensor would need to be added. In a large steam generator vessel, containing rapidly-moving high temperature steam and water, it would be difficult to insert both a flow meter and a thermometer into the downcomer 40. This, plus the need for additional computation, makes the two-tap differential pressure arrangement of FIG. 2 the preferred device for measuring flow.

The measure of flow in the downcomer 40 made possible by the sensor 70 and pipes 72, 74 is important because that flow rate is related to the difference in water levels between the riser 20 and the downcomer 40, and the masses of fluid in them. The height of water in the downcomer 40 is known directly, to good accuracy, from the pressure across the narrow range sensor 50; the mass change in the riser, which the operator needs to control the steam generator properly, can be found from the narrow range pressure and the flow measurement from the sensor 70 according to the methods of the present invention.

The method of the present invention has two aspects. There is a rough method, and a more precise look-up method.

To use the rough method, the operator takes the pressure shown by the sensor 70 and converts it to a level difference (between the downcomer 40 level and the riser 20 level) by multiplying the indicated pressure by a constant of proportionality k. The k factor is obtained experimentally at one power level, as follows:

With the steam generator in steady-state operation, say at 10% of full power, the narrow-range pressure gauge reading is noted. Then the generator is shut down. The steam outlet valve (not shown) and the feedwater control valve (not shown) are both closed to prevent entry or exit of water or steam from the generator. At the same time the flow of heat into the steam generator is stopped. The steam generator is now isolated from mass and heat changes.

The result will be this: with boiling in the riser 20 stopped, and all cessation of circulation-between the riser 20 and the downcomer 40, the water levels in the riser and downcomer will come to the same level. When the steam generator is calm, the narrow range gauge is again read. The reading will be different because the flow has ceased. The difference in pressure readings before and after the shutdown is the "shrink". It is used to find the k factor which is $$k = \frac{\text{shrink in the narrow range converted to inches of water}}{\text{sensor 70 reading change due to shutdown}}$$

using the data from the shutdown.

On the assumption that level difference is proportional to flow, the k factor is multiplied by the difference in pressure readings of the sensor 70 to directly obtain the shrink.

The shrink gives the operator valuable information about the level in the riser. (The term "level" is somewhat misleading, since the violent boiling at higher powers does not allow definition of a real surface; nevertheless, the mass of water in the riser corresponds to a calm surface level, so "level" is proportional to the mass.)

To find the shrink to greater accuracy, the operator may use the second method of the present invention, which employs a look-up table which has been carefully figured to compensate for the various non-linearities in both the pressure to flow conversion and in the steam generator itself.

Non-linearities enter in the viscous friction effect and in the speed squared term of the Bernoulli effect in the pressure sensor 70. Also, the varying cross-sections of the riser and downcomer mean that the mass of water in the riser 20, in which the operator is interested, will not change proportionally to the level.

The look-up table will incorporate the results of shutdown tests, such as that described above, and/or the results of careful thermodynamic calculations or computer simulations based on the particular construction of the steam generator. The table would list combinations of narrow range readings and flow readings, and give the mass of water in the riser and the mass in the generator for each combination.

Figure 3:
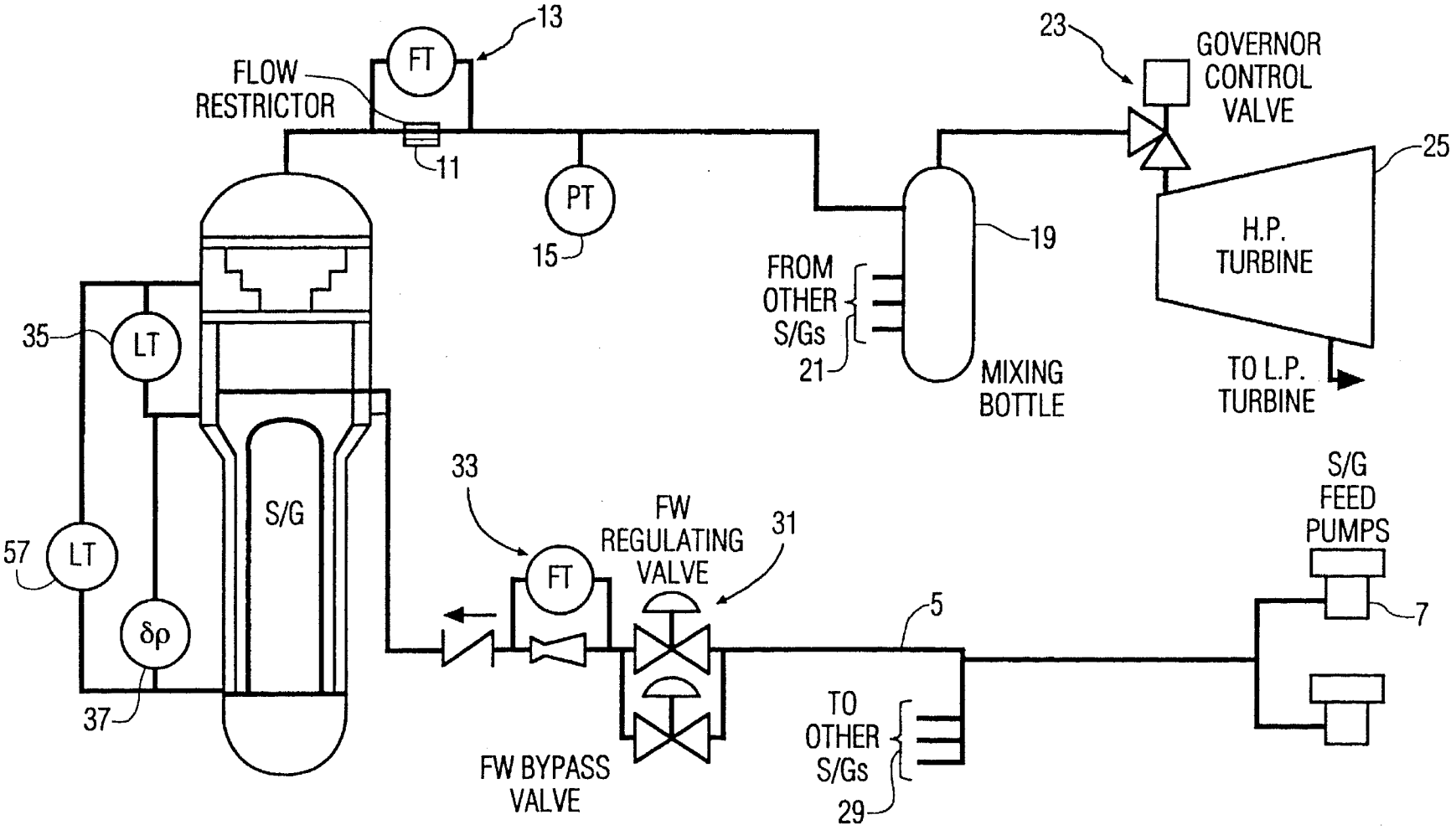
FIG. 3 is a mechanical schematic drawing of a steam generator system including a feedwater system according to the present invention.
Figures 4, 4A:
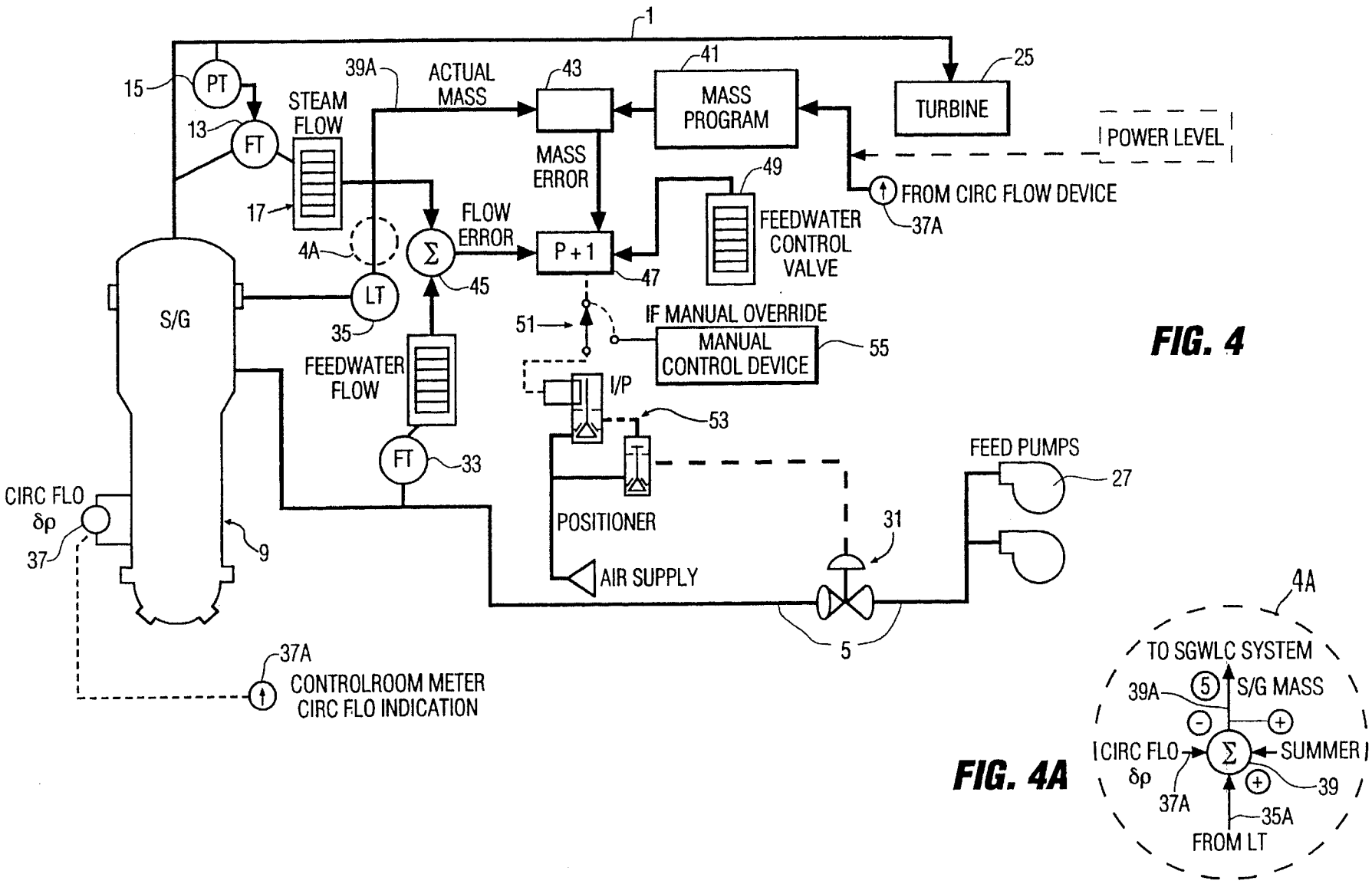
FIG. 4 is a schematic drawing of the control elements of the steam generator of FIG. 3.
FIG. 4A is a detail of FIG. 4.

Referring now to FIGS. 3 and 4, one example of a steam generator system that includes the present invention will be described. For simplicity, FIG. 3 shows the basic mechanical and FIG. 4 and 4A shows the basic control hookup of the same system.

Steam piping 1 is shown connected to the load such as electrical generating turbine 25. The return piping 5 is shown from the feed pumps 27 back to the steam generator 9. Starting at steam generator 9, the steam passes through a flow throttling device 11 to allow measurement of the steam flow by differential pressure transmitter 13. The steam flow device should be compensated for steam density changes in the steam, so the steam pressure is measured by pressure transmitter 15 to give the density which is used to determine the true steam flow in a meter 17.

Typically, for plants with multiple steam generators, the steam from the steam generator 9 is piped to a mixing bottle 19 where it is mixed with steam from the other steam generators, shown entering at 21. The combined steam is then piped to a governor control valve 23 and the load 25, which for an electric power plant is a turbine generator. After transferring power to the turbine 25, the steam passes through a condenser (not shown) and enters the feed pumps 27, which return the condensed water to the steam generator 9 and the other steam generators 29 through piping 5.

The feedwater flow is monitored by a feedwater detector 33 and controlled by the feedwater regulating valve 31. The detector 33 can be placed on either side of the regulating valve 31 but the arrangement shown is preferred.

In order to control the water levels in steam generator 9, a differential pressure device 35 functions to detect the differential pressure in the narrow range and therefore the water level in the downcomer, as described above. The signal output 35A of device 35 is combined with the output signal 37A of the downcomer differential pressure device 37 in a signal summer 39 whose output 39A is an indication of the actual liquid mass in the steam generator.

The system is designed to control the feedwater injection to steam generator 9 by adjusting automatically or enabling manual adjustment of control valve 31 in relation to the appropriate mass that should be in the steam generator 9 for respective power conditions of the system. One example for generating this control is shown with the use of a mass program indicator 41, which receives either the differential pressure reading from differential pressure transmitter 37 or a signal indicative of the power level of the load 25. The mass program indicator 41 is programed to assure that the moisture separators are not flooded out by the downcomer level rising too high or the riser level becoming too low, all as described above. If the mass programmer uses the reading from the differential pressure transmitter 37 (37A) to determine the desired mass, then a time delay device may be used to dampen rapid but insignificant changes and transients in the downcomer flow.

A further explanation of the mass program indicator may be helpful. The mass in the steam generator 9 is a function of the level of the water in the narrow range and the downcomer and the level in the riser section. Under static conditions in the steam generator, with the system in hot standby, the levels in the riser and downcomer are essentially the same. Therefore, the level in the downcomer will produce a signal from differential pressure transmitter 35 representative of the mass of liquid in the steam generator. For example, in the Westinghouse Model 51 S/G, a level of 33% in the narrow range level detector 35 while in hot standby would represent xxxxx lbm.

For steam generator at 100% flow conditions, the level indicated in the narrow range by itself would no longer represent the mass of water in the steam generator. The additional information required would be how much =less mass would be in the riser section as a result of the steam production. The preferred representation of this is the differential pressure change in the downcomer flow device 37 from the static to the 100% flow condition. For example, using the same Westinghouse model, the downcomer flow device 37 at hot standby reads a pressure differential of 3,879 psi. Then at 100% steam flow this might change to 4,879 psi. This 1 psi difference multiplied by the constant (k) derived for this steam generator as described above and added to the 33% figure from the downcomer converted to a delta P would yield a value representative of liquid mass (e.g. wwww lbm).

Therefore, at any time, the combination of the narrow range level device 35 delta P and the difference between device 37 delta P reading from its hot standby reading, represents or indicates the mass in the steam generator. The desired narrow range level for any respective power level and the desired mass to produce this level at any power level can now be determined. The differential pressure device 37 will provide the input as to what mass will be optimum for the power conditions of the system. For example, using the same Westinghouse model, at 0% steam flow, the downcomer desired level should be 33% and the mass required to produce that level is xxxx lbm. Then at 100% steam flow the desired level in the downcomer should be 44% and the mass required to produce that level would now only be yyyy lbm. Therefore the difference in delta P in the downcomer differential pressure device 37 at 0% and the expected delta P of 3,879 psi would be zero. Then at 100% steam flow conditions the downcomer flow device change from static conditions of 1 psi would represent the desired mass of yyyy lbm.

The mass program indicator 41 would then provide a variable (preferably linear) between the xxx lbm to the yyy lbm in response to the delta P output of the device 37. Only one combination of narrow range level and downcomer mass flow rate would produce a match with the mass program indicator 41.

As mentioned above, the output of summer 39 is indicative of the actual mass in the steam generator 9. The output of indicator 41 provides the indication of the proper liquid mass in the generator for the existing power or circulation conditions in the steam generator. These output signals are compared in summer 43, the output of which is indicative of the mass error in the steam generator.

The steam flow indicated at meter 17 is compared to the feedwater flow indicator 33 in a summer 45 to generate an output signal indicative of the flow error. In past error feedwater control systems, this flow error device was necessary due to the erroneous indications of steam generator mass caused by the shrink and swell phenomenon. It was necessary to limit the level error signal masking the actual mass change in the steam generator caused by shrink and swell, by using this flow error device. This speeded up the response of the system by limiting the flow error between the steam and feed flows to a small amount. The attempt was to prevent drastic swings in levels in the system. Since the present invention gives a more instantaneous indication of steam generator mass and its changes, this flow error device 45 may not be needed for use in the present invention. Nevertheless, some system designers or operators may prefer to have it in the system.

If the flow error signal is used, the mass error signal of summer 43 is combined in summer 47 with the flow error signal of summer 45 and the output signal of the feedwater control position indicator 49. If the flow error is not used then the mass error signal would be used for feedwater control without it.

Feedwater control can be automatic or manual depending on the position of switch 51. If manual, the operator need only watch the meter (not shown) that indicates the output signal of summer 39 and the system power meter, not shown, and adjust positioner 53 by operating a manual control device 55 until such mass reading moves to a suitable range, as described below. To the extent the operator desires to know the other parameters, they would be displayed for the operator's use.

If automatic, the error signal, if any, will control the compressed air or hydraulic positioner 53 to adjust feedwater control valve 31 to add or cut back on the feedwater flow rate until the error signal from summer 47 returns to within an acceptable range or a predetermined value. In this way, the mass and therefore the related liquid levels in the downcomer and indirectly in the riser can be rapidly and accurately controlled to the proper conditions of the steam generator.

It should be understood that various modifications can be made to the embodiments disclosed herein without departing from the spirit and scope of present invention. Also, it should be understood that the invention has application in a variety of steam generator and boiler types, such as nuclear and fossil fired steam generators and boilers, either stationary or marine. For example, marine boilers have variously designed components that provide similar functions to those described herein for the steam generator. That is, marine boilers have a riser section through which water and steam mixture flows and in which heat is transferred to the fluid therein. A pressure vessel usually called a drum receives the heated fluid from the riser to enable separation of the steam and water. Pressurized steam exits the drum toward the load and the liquid drains into a downcomer that directs it and injects feedwater toward the riser inlet. The liquid in the drum is equivalent to the liquid in the narrow range. These prior art boilers also experience the shrink and swell phenomenon.

What is claimed is:

1. A feedwater control apparatus for a steam generation system of the type including a pressure vessel having a upper zone in which steam and water are separated, a riser having a top communicating with the upper zone and a riser bottom to receive fluid for flow therethrough to said upper zone, heating means for heating the fluid within the riser, a downcomer communicating with the upper zone for recirculating water from the upper zone and for circulating feedwater toward the riser bottom, and a narrow range pressure sensor for measuring a narrow range water level in the upper zone, said feedwater control system comprising, a. first measuring means for sensing the mass flow rate of water in the downcomer, b. second measuring means for sensing the height of liquid in the upper zone, c. control means responsive to said first and second measuring means for producing control information related to the total mass of fluid in upper zone, riser, and downcomer, and d. feedwater control means operable in response to said control means for controlling the amount of feedwater delivered to the downcomer.

2. The feedwater control system as set forth in claim 1, wherein said first measuring means comprises, a. a differential pressure sensor having one side communicating with the downcomer interior generally at a lower elevation thereof, and b. a pipe communicating with the other side of the differential pressure sensor and with the downcomer interior at a generally upper elevation thereof.

3. An apparatus for calculating the mass of fluid in a natural flow, recirculating steam generator of the type including a pressure vessel having a wall, a central riser within the vessel, said riser open at a riser top and at a riser bottom for fluid to circulate through the riser, heating elements located within the riser, a downcomer surrounding the riser for recirculating water boiling over the riser top to pass therethrough from the riser top to the riser bottom, and a narrow range pressure gauge for measuring a narrow range water level in an upper part of the pressure vessel, said apparatus comprising:

a. a differential pressure sensor, said sensor disposed generally at a lower part of the downcomer, a bottom tap communicating with a lower part of the downcomer, said sensor having a first side hydraulically connected to said bottom tap;

b. a pipe hydraulically connecting a lower narrow range tap to a second side of said sensor, said narrow range lower tap located above said bottom tap; and c. operator readable gauge means attached to said sensor, for displaying a value related to a pressure difference between a first pressure on said first side of said sensor and a second pressure on a second side of said sensor.

4. Apparatus for use in controlling a rate of feedwater flow to a natural flow, recirculating steam generator of the type including a pressure vessel, a downcomer, and a riser section, said riser section open at a riser top and at a riser bottom for fluid to circulate upward through the riser section, heating elements located to heat the fluid within the riser section, the downcomer communicating to recirculate water boiling over the riser top to pass downward through the downcomer from the downcomer top to the downcomer bottom and flow into the riser bottom, and a narrow range gauge for indicating the liquid level in the narrow range of the pressure vessel, the apparatus comprising, a. sensor means for generating a value related to the differential pressure of the natural flow of fluid between two vertically displaced zones in said downcomer, b. gauge means coupled to said sensor means for displaying to an operator indications related to the value generated by said sensor means, and wherein c. the displayed indications of the narrow range gauge and said gauge means indicating the mass of liquid in the narrow range, downcomer, and riser section of the steam generator.

* * * * *